US008319133B2

(12) United States Patent
Gottschalk et al.

(10) Patent No.: US 8,319,133 B2
(45) Date of Patent: Nov. 27, 2012

(54) ELECTRICAL SWITCHING APPARATUS AND CHARGING ASSEMBLY THEREFOR

(75) Inventors: Andrew Lawrence Gottschalk, Pittsburgh, PA (US); Robert Michael Slepian, Murrysville, PA (US)

(73) Assignee: Eaton Corporation, Cleveland, OH (US)

( * ) Notice: Subject to any disclaimer, the term of this patent is extended or adjusted under 35 U.S.C. 154(b) by 287 days.

(21) Appl. No.: 12/917,825

(22) Filed: Nov. 2, 2010

(65) Prior Publication Data

US 2012/0103775 A1 May 3, 2012

(51) Int. Cl.
*H01H 5/00* (2006.01)

(52) U.S. Cl. ..... 200/400; 218/154; 335/6; 335/16

(58) Field of Classification Search ..... 200/400, 200/401, 500, 501, 17 R, 330, 331, 323–325; 218/153, 154; 335/6, 16
See application file for complete search history.

(56) References Cited

U.S. PATENT DOCUMENTS

| | | | | |
|---|---|---|---|---|
| 4,475,021 | A * | 10/1984 | Mochizuki et al. | 200/400 |
| 4,742,200 | A * | 5/1988 | Marquardt et al. | 200/325 |
| 5,889,250 | A * | 3/1999 | Castonguay | 218/154 |
| 6,160,234 | A * | 12/2000 | Wehrli et al. | 200/400 |
| 7,186,937 | B1 | 3/2007 | Ricciuti et al. | |
| 7,449,652 | B2 | 11/2008 | Rakus et al. | |
| 7,449,653 | B2 | 11/2008 | Gibson et al. | |
| 7,518,076 | B1 | 4/2009 | Gottschalk et al. | |
| 7,586,055 | B2 | 9/2009 | Jones et al. | |
| 7,687,733 | B2 | 3/2010 | Weister et al. | |
| 7,696,448 | B2 | 4/2010 | Rakus et al. | |
| 7,902,472 | B2 * | 3/2011 | Godesa | 200/400 |
| 7,906,740 | B2 * | 3/2011 | Gopikrishnan Babu et al. | 200/400 |
| 2002/0092752 | A1 * | 7/2002 | Marin-Pache et al. | 200/400 |
| 2008/0087534 | A1 * | 4/2008 | Yang et al. | 200/400 |
| 2010/0078300 | A1 | 4/2010 | Freundt et al. | |

FOREIGN PATENT DOCUMENTS

EP 0 062 414 A1 10/1982

OTHER PUBLICATIONS

European Patent Office, "extended European Search Report", Feb. 21, 2012, 7 pp.

* cited by examiner

*Primary Examiner* — Michael Friedhofer
(74) *Attorney, Agent, or Firm* — Eckert Seamans Cherin & Mellott, LLC; Grant E. Coffield

(57) ABSTRACT

A charging assembly for an electrical switching apparatus includes a cam shaft and including a number of cams. A latch lobe and a charging handle are coupled to opposing ends of the cam shaft. Each stroke of the charging handle pivots the cams a predetermined amount. A rocker arm includes a first portion cooperating with the cams, a second portion translating movement of the cams into movement of a stored energy mechanism, and a third portion cooperating with a close D-shaft having a close latch. A close prop includes a first end cooperating with the close D-shaft, and a second end including a roller that cooperates with the latch lobe. The close D-shaft pivots between latched and unlatched positions. The third portion cooperates with the close D-shaft to hold the close latch in the unlatched position until the charging handle has been pivoted a predetermined number of strokes.

20 Claims, 6 Drawing Sheets

2

ELECTRICAL SWITCHING APPARATUS AND CHARGING ASSEMBLY THEREFOR

BACKGROUND

1. Field

The disclosed concept relates generally to electrical switching apparatus and, more particularly, to electrical switching apparatus, such as circuit breakers. The disclosed concept also relates to charging assemblies for circuit breakers.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts that are separable from the stationary electrical contacts.

Among other components, the operating mechanisms of some stored energy circuit breakers, for example, typically include a pole shaft, a trip actuator assembly, a closing assembly and an opening assembly. The trip actuator assembly responds to the trip unit and actuates the operating mechanism. The closing assembly and the opening assembly may have some common elements, which are structured to move the movable electrical contacts between a first, open position, wherein the movable and stationary electrical contacts are separated, and a second, closed position, wherein the movable and stationary electrical contacts are electrically connected.

The closing assembly includes a chargeable stored energy mechanism such as, for example and without limitation, a closing spring, as well as a close latch, a charging handle, and a close button to actuate (e.g., discharge) the closing spring to facilitate the closing process. The charging handle for the closing assemblies of some circuit breakers includes a ratcheting mechanism with a pawl that engages recesses or teeth in a ratchet at the base of the handle in an attempt to resist undesired handle backlash. It is possible, however, for the close latch or other closing assembly components to become damaged, for example, by forces and an associated collision of components resulting from a sudden release of the charging handle during the charging process, before the pawl can stop the backwards rotation.

There is, therefore, room for improvement in electrical switching apparatus, such as circuit breakers, and in charging assemblies therefor.

SUMMARY

These needs and others are met by embodiments of the disclosed concept, which are directed to a charging assembly for an electrical switching apparatus, such as a circuit breaker. Among other benefits, the charging assembly includes a close latch protection feature for resisting damage to circuit breaker components that can be caused by sudden release of the charging handle, particularly early in the charging process.

As one aspect of the disclosed concept, a charging assembly is provided for an electrical switching apparatus. The electrical switching apparatus includes a housing, separable contacts enclosed by the housing, and an operating mechanism for opening and closing the separable contacts. The operating mechanism includes a stored energy mechanism. The charging assembly comprises: a cam shaft structured to be pivotably coupled to the housing, the cam shaft including a first end, a second end disposed opposite and distal from the first end, and a number of cams disposed between the first end and the second end; a latch lobe coupled to the cam shaft at or about the first end; a charging handle coupled to the cam shaft at or about the second end, the charging handle being structured to pivot a number of strokes, each stroke pivoting the cams a predetermined amount; at least one rocker arm structured to be pivotably coupled to the housing by a pivot, the at least one rocker arm including a first portion, a second portion and a third portion, the first portion cooperating with a corresponding one of the cams, the second portion being structured to translate movement of the cams into movement of the stored energy mechanism to charge the stored energy mechanism, the third portion being disposed proximate to the pivot; a close prop including a first end and a second end disposed opposite and distal from the first end, the second end including a roller cooperating with the latch lobe; and a close D-shaft structured to be pivotably coupled to the housing, the close D-shaft comprising a recess and a close latch, the close D-shaft being pivotable between a latched position corresponding to the close latch restricting movement of the first end of the close prop, and an unlatched position corresponding to the close prop being movable. The third portion of the at least one rocker arm is structured to cooperate with the close D-shaft at or about the recess to hold the close latch in the unlatched position until the charging handle has been pivoted a predetermined number of strokes to charge the stored energy mechanism a predetermined amount. After the predetermined number of strokes is achieved, the third portion of the at least one rocker arm releases the close D-shaft, thereby permitting the close latch to move to the latched position.

When the charging handle has been pivoted the predetermined number of strokes, the cam shaft may be correspondingly pivoted a predetermined distance. The predetermined distance may correspond to the latch lobe being disposed sufficiently distal from the roller of the close prop in order that release of the charging handle and corresponding backward rotation of the cam shaft would not result in a collision between the roller and the latch lobe. The third portion of the rocker arm may have a profile, and wherein the profile is structured to cooperate with the close D-shaft at or about the recess.

An electrical switching apparatus employing the aforementioned charging assembly is also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
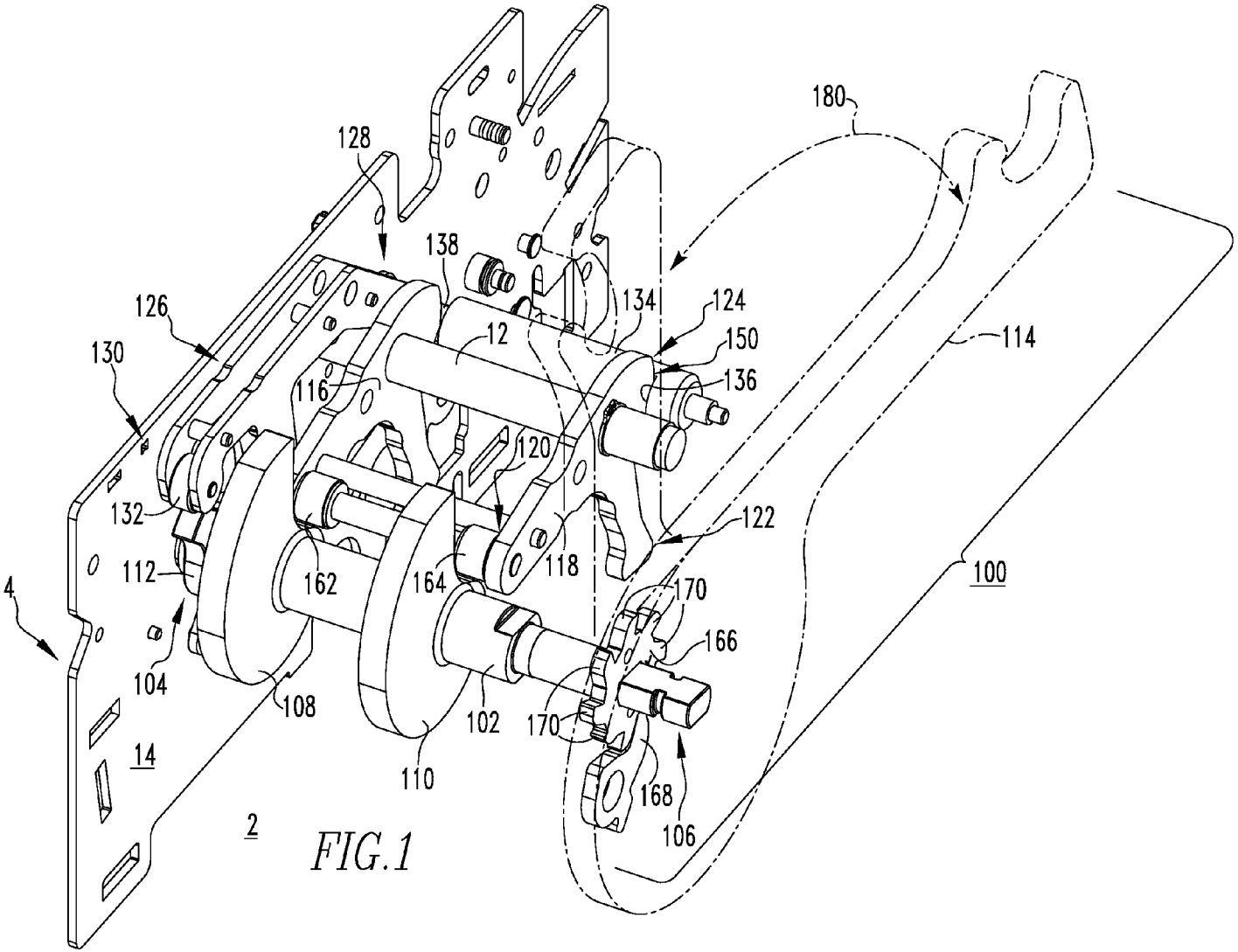
FIG. 1 is an isometric view of a portion of a circuit breaker and a charging assembly therefor, in accordance with an embodiment of the disclosed concept, shown as positioned when the circuit breaker is not charged.

Directional phrases used herein, such as, for example, front, back, top, bottom, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
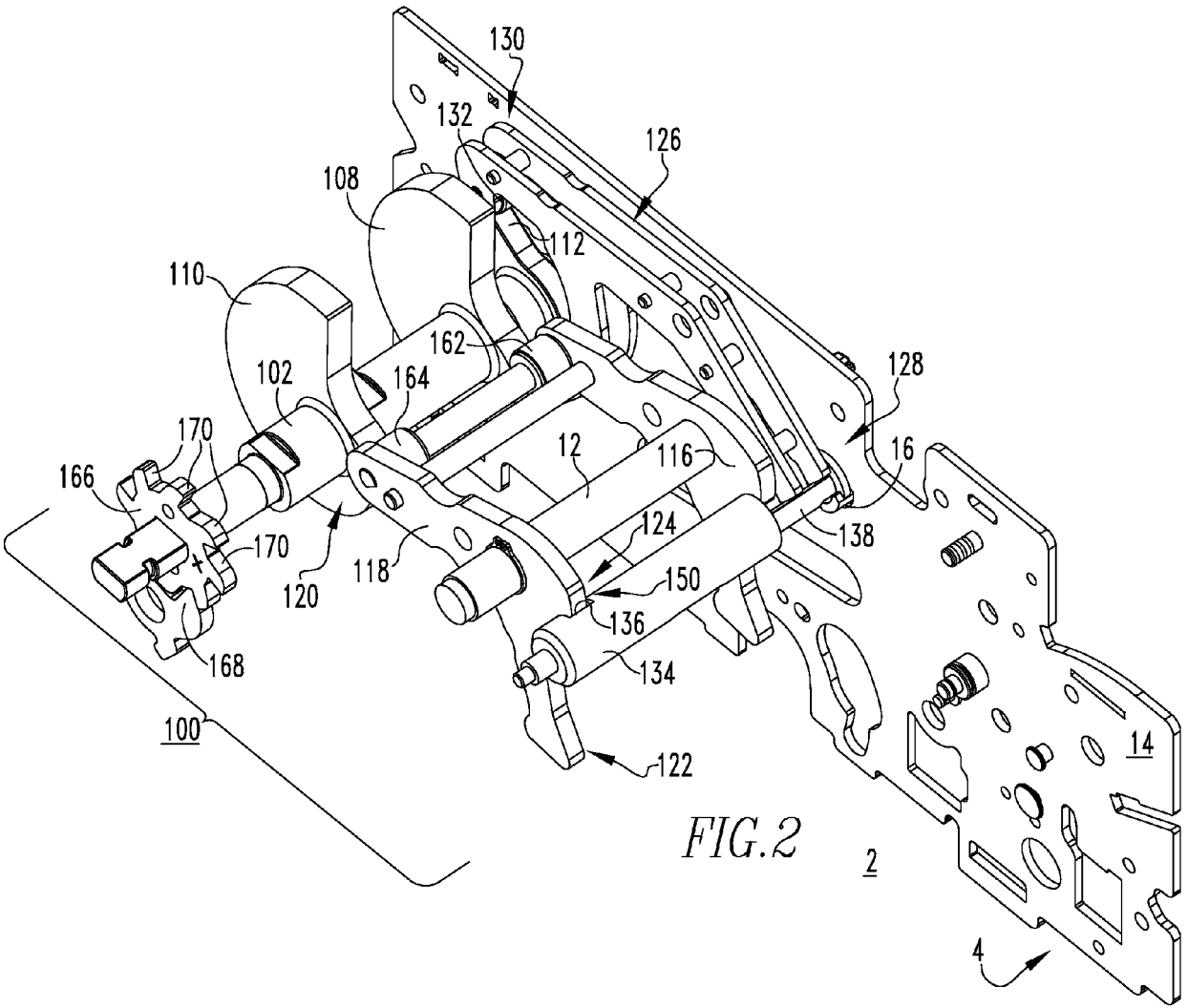
FIG. 2 is another isometric view of the portion of the circuit breaker and charging assembly therefor of FIG. 1.
Figure 3A:
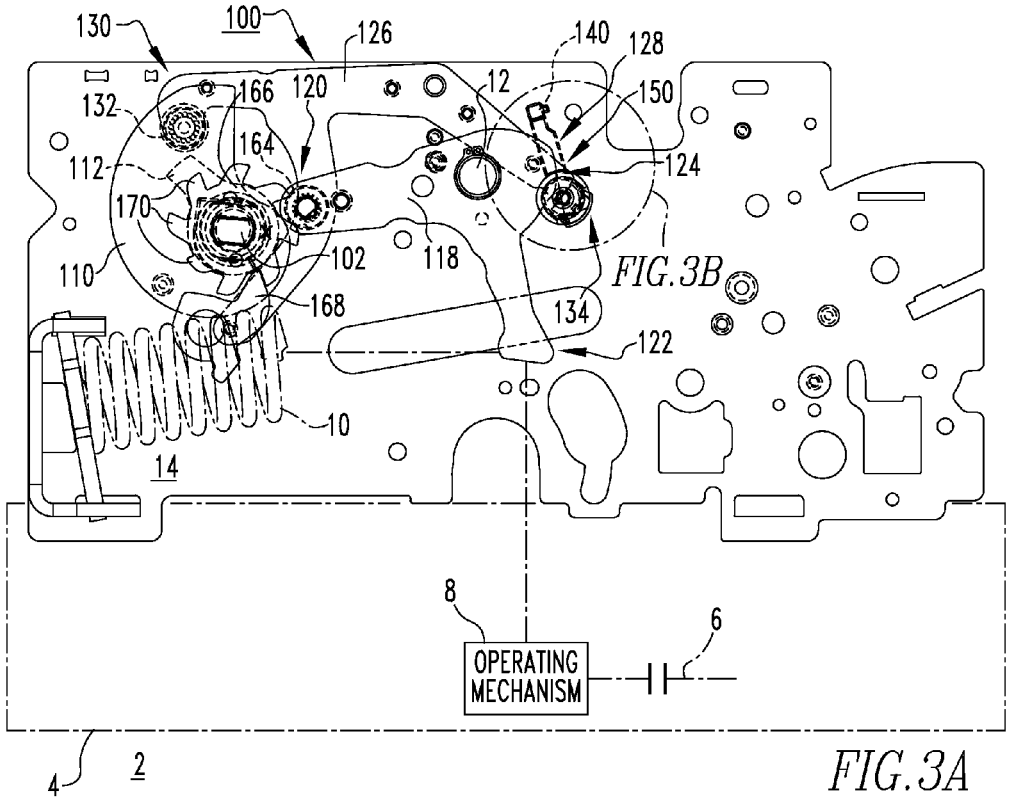
FIG. 3A is a side elevation view of the portion of the circuit breaker and charging assembly therefor of FIG. 2.

FIGS. 1-3A show a portion of an electrical switching apparatus such as, for example, a circuit breaker 2 employing a charging assembly 100 in accordance with an embodiment of the disclosed concept. As shown in FIG. 3A in simplified form in phantom line drawing, the circuit breaker 2 includes a housing 4, separable contacts 6 enclosed by the housing 4, and an operating mechanism 8 for opening and closing the separable contacts 6 in a generally well known manner. The operating mechanism 8 (shown in simplified form in FIG. 3A) includes a stored energy mechanism 10 (e.g., without limitation, closing spring) (partially shown in phantom line drawing in FIG. 3A).

As shown in FIGS. 1 and 2, the charging assembly 100 includes a cam shaft 102 pivotably coupled to the circuit breaker housing 4. The cam shaft 102 has opposing first and second ends 104,106 and a number of cams 108,110 (two are shown herein) disposed on the cam shaft 102 between the first and second ends 104,106. A latch lobe 112 is coupled to the cam shaft 102 at or about the first end 104, and a charging handle 114 (shown in phantom line drawing in FIG. 1) is coupled to the cam shaft 102 at or about the second end 106. The charging handle 114 is pivotable (e.g., clockwise and counterclockwise in the direction of arrow 180 from the perspective of FIG. 1) a number of strokes, in order to charge the stored energy mechanism 10 (FIG. 3A) in a generally known manner. More specifically, each stroke of the charging handle 114 pivots the cams 108,110 a predetermined amount. The cams 108,110, in turn, cooperate with rocker arms 116,118 (two are shown in the example embodiment of FIGS. 1 and 2) that are pivotably coupled to the circuit breaker housing 4 by a pivot 12. For ease of illustration and economy of disclosure, only one rocker arm 118 will be described in detail herein. Specifically, the rocker arm 118 includes a first portion 120, a second portion 122, and a third portion 124. The first portion 120 cooperates with a corresponding one of the cams 110. The second portion 122 translates movement of the cams 108,110 into movement of the stored energy mechanism 10 (FIG. 3A) to charge the stored energy mechanism 10 (FIG. 3A). The third portion 124 is disposed proximate to the pivot 12 and performs the desired close latch protection function as will be described in greater detail hereinbelow.

A close prop 126, which includes a first end 104 and a second end 106 disposed opposite and distal from the first end 104, is also pivotably coupled to the circuit breaker housing 4. The second end 106 of the close prop 126 includes a roller 132, which cooperates with the latch lobe 112, as best shown in FIGS. 1 and 2. A close D-shaft 134, which is also pivotably coupled to the housing 4, includes a recess 136 and a close latch 138 (FIGS. 1 and 2). The close D-shaft 134 is pivotable between a latched position (FIGS. 6A and 6B) corresponding to the close latch 138 restricting movement of the first end 104 of the close prop 126, and an unlatched position (FIGS. 1-5B) corresponding to the close prop 126 being movable.

It will be appreciated that the third portion 124 of the rocker arm 118 cooperates with the close D-shaft 134 and thereby functions as a close latch protection feature/mechanism to resist undesired damage to charging assembly components caused, for example and without limitation, by a sudden release of the charging handle early in the charging process. More specifically, in conventional circuit breakers (not shown) a sudden release of the charging handle during charging allows the spring-driven rocker arms to drive the cam shaft rapidly backwards until it is stopped and held by the handle fixed pawl of the latching handle mechanism. If this release takes place during the first few handle strokes of the charging handle (e.g., early in the charging process), the close latch components (e.g., without limitation, close prop; roller; latch lobe) may collide before the handle fixed pawl can stop the rotation. Such a collision could rotate the arms of the close prop and damage the close latch if the close D-shaft has already been reset (e.g., if the close D-shaft has been rotated by its reset spring to stop passage of the close prop). The disclosed concept addresses and overcomes the foregoing disadvantages of the prior art by incorporating the aforementioned close latch protection feature/mechanism as a unique feature of the rocker arm 118.

Figure 3B:
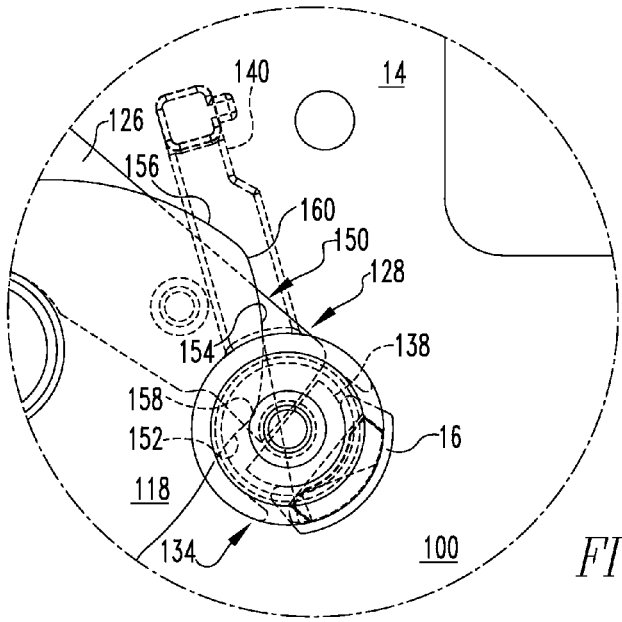
FIG. 3B is an enlarged view of a close latch protection feature of the charging assembly of FIG. 3A.
Figure 4A:
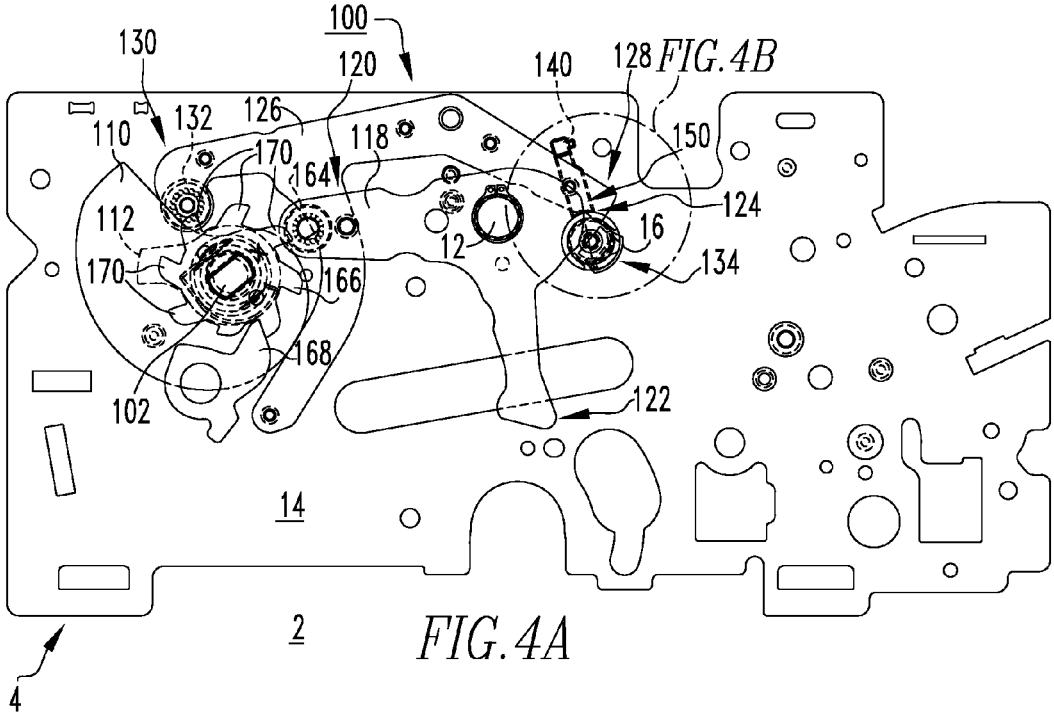
FIG. 4A is a side elevation view of the portion of the circuit breaker and charging assembly therefor, shown after the circuit breaker has been partially charged by pivoting the charging handle one stroke.
Figure 4B:
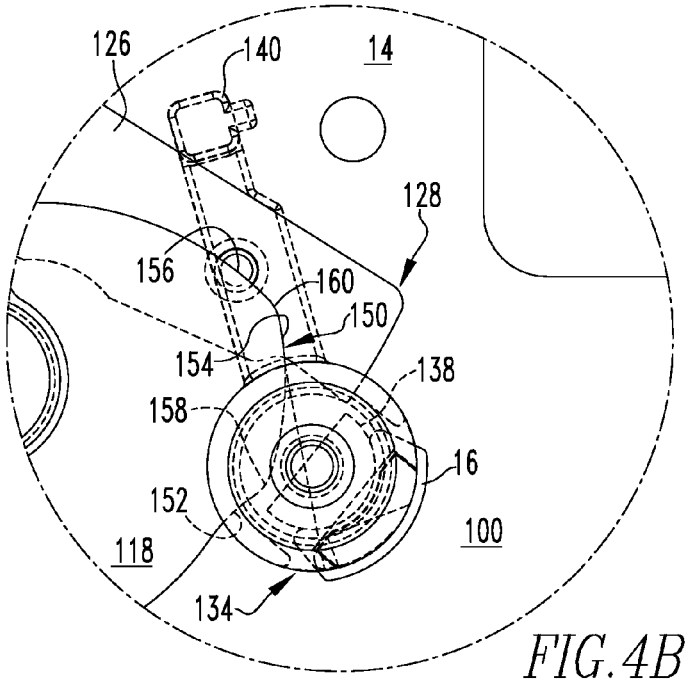
FIG. 4B is an enlarged view of the close latch protection feature of the charging assembly of FIG. 4A.
Figure 5A:
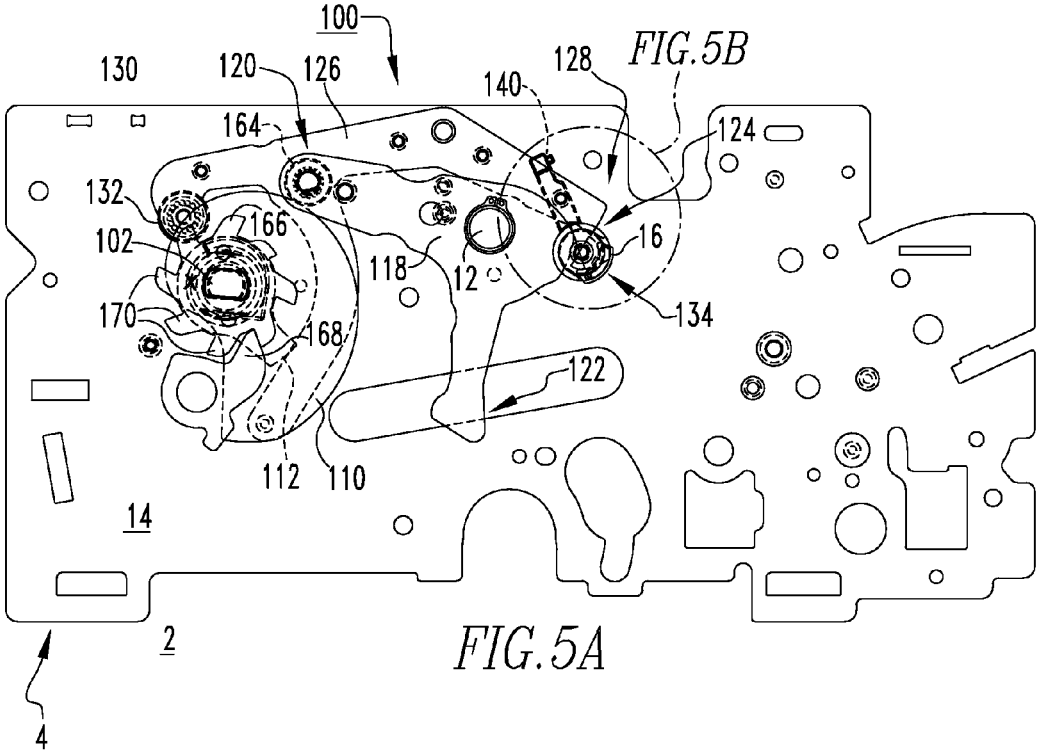
FIG. 5A is a side elevation view of the portion of the circuit breaker and charging assembly therefor, shown after the circuit breaker has been partially charged by pivoting the charging handle four strokes.
Figure 5B:
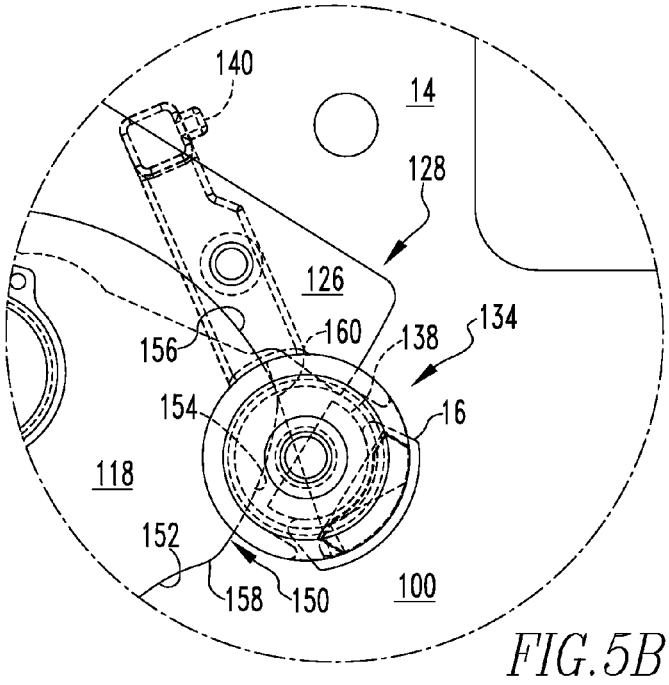
FIG. 5B is an enlarged view of the close latch protection feature of the charging assembly of FIG. 5A.

Specifically, the rocker arm 118 cooperates with the close D-shaft 134 at or about the recess 136 thereof to hold the close latch 138 in the unlatched position (FIGS. 1-5B) until the charging handle 118 has been pivoted a predetermined number of strokes to charge the stored energy mechanism 10 a predetermined amount. After the predetermined number of strokes is achieved, the third portion 124 of the rocker arm 118 releases the close D-shaft 134, thereby permitting the close latch 138 to move to the latched position. FIGS. 1-4B illustrate the third portion 124 of the rocker arm 118 holding the close D-shaft 134 in the unlatched position in this manner. In other words, movement of the close latch 138 to the latched position (FIGS. 6A and 6B), is delayed in accordance with the disclosed concept, until the charging handle 114 has sufficiently charged the stored energy mechanism 10. In one non-limiting example embodiment, the predetermined number of strokes of the charging handle 114 is four strokes. However, it will be appreciated that any other known or suitable number of strokes would fall within the scope of the disclosed concept. FIGS. 5A and 5B illustrate the position of the charging assembly components after the charging handle 114 has been pivoted four strokes. As shown in enlarged view of FIG. 5B, under such circumstances, the rocker arm 118 is beginning to release the close D-shaft 134 and, in particular, the close latch 138 (FIGS. 1 and 2), to be moved to the latched position.

Figure 6A:
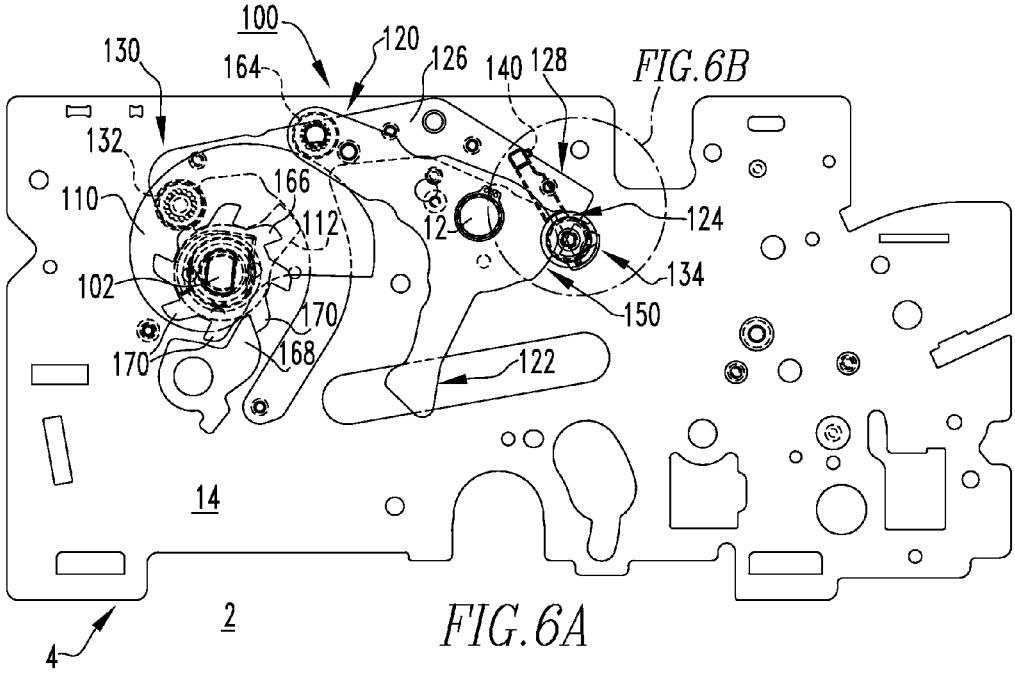
FIG. 6A is a side elevation view of the portion of the circuit breaker and charging assembly therefor, shown after the circuit breaker has been charged by pivoting the charging handle six strokes.
Figure 6B:
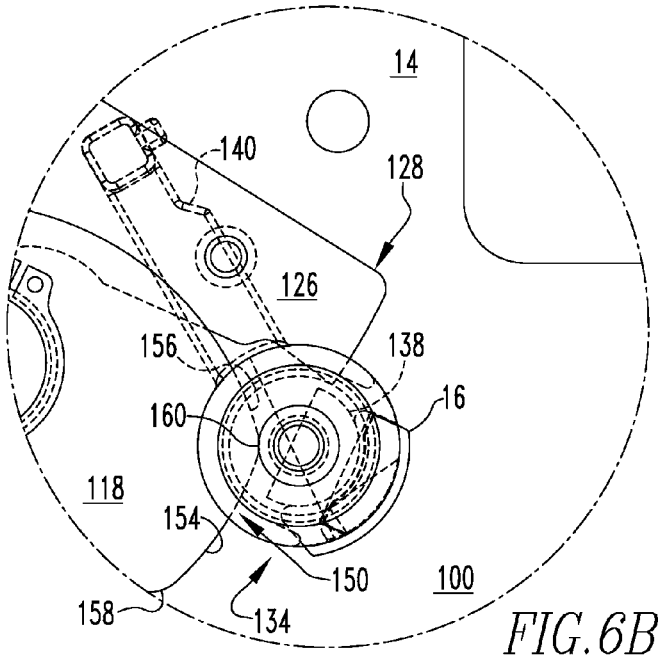
FIG. 6B is an enlarged view of the close latch protection feature of the charging assembly of FIG. 6A.

FIGS. 6A and 6B show the charging assembly 100 after the close D-shaft 134 and close latch 138 have been fully released, after six strokes of the charging handle 114, and the close latch 138 has been moved to the latched position (best shown in hidden line drawing in the enlarged view of FIG. 6B).

Continuing to refer to FIGS. 5A-6B, it will be appreciated that, in accordance with the disclosed concept, when the charging handle 114 (FIG. 3A) has been pivoted the predetermined number of strokes (e.g., without limitation, four strokes), the cam shaft 102 and cams 108,110 have been correspondingly pivoted a predetermined distance. Such predetermined distance corresponds to the latch lobe 112 (partially shown in hidden line drawing in FIGS. 5A and 6A) also having pivoted and, therefore, being disposed sufficiently distal from the roller 132 (shown in hidden line drawing in FIGS. 5A and 5B) of the close prop 126, in order that release of the charging handle 114 and corresponding backward rotation of the cam shaft 102 (FIGS. 5A and 6A) would not result in the aforementioned collision between the roller 132 and the latch lobe 112.

Referring again to FIGS. 2 and 3A-6B, the housing 4 of the example circuit breaker 2 includes at least one side plate 14. The side plate 14 includes a stop 16, and the close D-shaft 134 includes a lever 140 (FIGS. 3A-6B). The cam shaft 102, rocker arms 116,118, close prop 126, and close D-shaft 134 are all pivotably coupled to the side plate 14, as best shown in FIGS. 1 and 2. The cam shaft 102 of the example charging assembly 100 includes first and second cams 108,110, and first and second rocker arms 116,118. The first rocker arm 116 includes a first cam roller 162, and the second rocker arm 118 includes a second cam roller 164. The first cam roller 162 preferably cooperates with the first cam 108, and the second cam roller 164 preferably cooperates with the second cam 110, as shown. When the charging handle 114 has been pivoted the aforementioned predetermined number of strokes, the lever 140 of the close D-shaft 134 engages the stop 16 of the side plate 14, as best shown in FIG. 6B.

The close latch protection feature/mechanism will now be described in greater detail. Specifically, as previously discussed, the rocker arm 118 includes a third portion 124 proximate the pivot 12. The third portion 124 has a profile 150. It is this profile 150 that cooperates with the close D-shaft 134 at or about the recess 136 (FIGS. 1 and 2) thereof, in order to perform the aforementioned function of delaying resetting of the close latch 138 (FIGS. 1 and 2). More specifically, in the non-limiting example shown and described herein, the profile 150 preferably includes a first segment 152, a second segment 154, a third segment 156, a first transition 158, and a second transition 160 (all shown in FIGS. 3B, 4B, and 5B). The first segment 152 is concave, whereas the second segment 154 and the third segment 156 are convex. The first transition 158 is disposed between the first and second segments 152,154, and the second transition 160 is disposed between the second and third segments 154,156. The transitions 158,160 in the example shown and described herein each comprise a relatively abrupt change in radius of curvature, which correspondingly results in a camming action or displacement of the rocker arm 118 and/or close D-shaft 134, as desired.

The radius of curvature of the third segment 156 is greater than the radius of curvature of the second segment 154. It will, however, be appreciated that any known or suitable alternative shape, configuration and/or type of profile other than the profile 150 shown and described herein, could be employed without departing from the scope of the disclosed concept. The interaction of the profile 150 with the close D-shaft 134 in order to control movement of the close latch 138 in accordance with the disclosed concept, is best shown in the enlarged views of FIGS. 3B, 4B, 5B and 6B. Specifically, when the charging handle 114 (FIG. 1) has not been pivoted and the stored energy mechanism 10 (FIG. 3A) has not been charged, the first transition 158 of the profile 150 engages the close D-shaft 134 and holds the close latch 138 in the unlatched position, as illustrated in FIG. 3B. When the charging handle 114 (FIG. 1) has been pivoted one stroke to begin charging the stored energy mechanism 10 (FIG. 3A), the second segment 154 of the profile 150 engages the close D-shaft 134 and continues to hold the close latch 138 in the unlatched position, as shown in FIG. 4B. When the charging handle 114 (FIG. 1) has been pivoted four strokes, the second segment 154 of the profile 150 begins to release the close D-shaft 134, as shown in FIG. 5B. When the charging handle 114 (FIG. 3A) has been pivoted six strokes, as illustrated in FIG. 6B, the second transition 160 of the profile 150 releases the close D-shaft 134, thereby releasing the close latch 138 to move to the latched position, as shown.

Referring again to FIGS. 1 and 2, the example charging handle 114 includes a charge gear 166 and a handle fixed pawl 168. The charge gear 166 has a plurality of teeth 170. When the charging handle 114 (FIG. 1) is pivoted, the handle fixed pawl 168 cooperates with the teeth 170. As previously discussed, when the charging handle 114 (FIG. 1) is released, the cam shaft 102 pivots backwards until the handle fixed pawl 168 engages a corresponding recess between adjacent teeth 170 to fix the position of the charging handle 114 (FIG. 1). In accordance with the close latch protection feature/mechanism of the disclosed concept, even if the handle fixed pawl 168 is not engaging the corresponding one of the teeth 170 or recesses, the third portion 124 of the rocker arm 118 will maintain the close latch 138 in the unlatched position until the charging handle 114 (FIG. 1) has been pivoted the predetermined number of strokes and the stored energy mechanism 10 (FIG. 3A) has been sufficiently charged, as previously described hereinabove.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A charging assembly for an electrical switching apparatus, said electrical switching apparatus including a housing, separable contacts enclosed by the housing, and an operating mechanism for opening and closing said separable contacts, said operating mechanism including a stored energy mechanism, said charging assembly comprising:

a cam shaft structured to be pivotably coupled to the housing, said cam shaft including a first end, a second end disposed opposite and distal from the first end, and a number of cams disposed between the first end and the second end;

a latch lobe coupled to said cam shaft at or about the first end;

a charging handle coupled to said cam shaft at or about the second end, said charging handle being structured to pivot a number of strokes, each stroke pivoting said cams a predetermined amount;

at least one rocker arm structured to be pivotably coupled to the housing by a pivot, said at least one rocker arm including a first portion, a second portion and a third portion, the first portion cooperating with a corresponding one of said cams, the second portion being structured to translate movement of said cams into movement of said stored energy mechanism to charge said stored energy mechanism, the third portion being disposed proximate to said pivot;

a close prop including a first end and a second end disposed opposite and distal from the first end, the second end including a roller cooperating with said latch lobe; and a close D-shaft structured to be pivotably coupled to the housing, said close D-shaft comprising a recess and a close latch, said close D-shaft being pivotable between a latched position corresponding to said close latch restricting movement of the first end of said close prop, and an unlatched position corresponding to said close prop being movable, wherein said third portion of said at least one rocker arm is structured to cooperate with said close D-shaft at or about said recess to hold said close latch in said unlatched position until said charging handle has been pivoted a predetermined number of strokes to charge said stored energy mechanism a predetermined amount, and wherein, after said predetermined number of strokes is achieved, said third portion of said at least one rocker arm releases said close D-shaft, thereby permitting said close latch to move to said latched position.

2. The charging assembly of claim 1 wherein, when said charging handle has been pivoted said predetermined number of strokes, said cam shaft has been correspondingly pivoted a predetermined distance; and wherein said predetermined distance corresponds to said latch lobe being disposed sufficiently distal from the roller of said close prop in order that release of said charging handle and corresponding backward rotation of said cam shaft would not result in a collision between the roller and said latch lobe.

3. The charging assembly of claim 2 wherein said predetermined number of strokes of said charging handle is four strokes.

4. The charging assembly of claim 1 wherein the housing of said electrical switching apparatus includes at least one side plate; wherein said at least one side plate includes a stop; wherein said cam shaft, said at least one rocker arm, said close prop and said close D-shaft are structured to be pivotably coupled to said at least one side plate; wherein said close D-shaft further comprises a lever; and wherein, when said charging handle has been pivoted a predetermined number of strokes, said lever is structured to engage said stop.

5. The charging assembly of claim 1 wherein said third portion of said at least one rocker arm has a profile; and wherein said profile is structured to cooperate with said close D-shaft at or about said recess.

6. The charging assembly of claim 5 wherein said profile includes a first segment, a second segment, a third segment, a first transition, and a second transition; wherein said first segment is concave; wherein said second segment and said third segment are convex; wherein said first transition is disposed between said first segment and said second segment; wherein said second transition is disposed between said second segment and said third segment; and wherein the radius of curvature of said third segment is greater than the radius of curvature of said second segment.

7. The charging assembly of claim 6 wherein, when said charging handle has not been pivoted and said stored energy mechanism has not been charged, said first transition of said profile engages said close D-shaft and holds said close latch in said unlatched position; wherein, when said charging handle has been pivoted one stroke to begin charging said stored energy mechanism, said second segment of said profile engages said close D-shaft and continues to hold said close latch in said unlatched position; wherein, when said charging handle has been pivoted four strokes, said second segment of said profile begins to release said close D-shaft; and wherein, when said charging handle has been pivoted six strokes, said second transition of said profile releases said close D-shaft, thereby releasing said close latch to move to said latched position.

8. The charging assembly of claim 1 wherein said number of cams of said cam shaft is a first cam and a second cam.

9. The charging assembly of claim 8 wherein said at least one rocker arm is a first rocker arm and a second rocker arm; wherein said first rocker arm includes a first cam roller; wherein said second rocker arm includes a second cam roller; wherein said first cam roller cooperates with said first cam; and wherein said second cam roller cooperates with said second cam.

10. The charging assembly of claim 1 wherein said charging handle comprises a charge gear and a handle fixed pawl; wherein said charge gear has a number of teeth; wherein, when said charging handle is pivoted, said handle fixed pawl cooperates with said teeth; wherein, when said charging handle is released, said cam shaft pivots backwards until said handle fixed pawl engages a corresponding one of said teeth to fix the position of said charging handle; and wherein, even if said handle fixed pawl is not engaging said corresponding one of said teeth, said third portion of said at least one rocker arm maintains said close latch in said unlatched position until said charging handle has been pivoted said predetermined number of strokes.

11. The electrical switching apparatus of claim 1 wherein said electrical switching apparatus is a circuit breaker; and wherein said stored energy mechanism is a closing spring.

12. An electrical switching apparatus comprising:

a housing;

separable contacts enclosed by the housing;

an operating mechanism for opening and closing said separable contacts, said operating mechanism comprising a stored energy mechanism; and a charging assembly comprising:

a cam shaft pivotably coupled to the housing, said cam shaft including a first end, a second end disposed opposite and distal from the first end, and a number of cams disposed between the first end and the second end, a latch lobe coupled to said cam shaft at or about the first end, a charging handle coupled to said cam shaft at or about the second end, said charging handle being pivotable a number of strokes, each stroke pivoting said cams a predetermined amount, at least one rocker arm pivotably coupled to the housing by a pivot, said at least one rocker arm including a first portion, a second portion and a third portion, the first portion cooperating with a corresponding one of said cams, the second portion translate movement of said cams into movement of said stored energy mechanism to charge said stored energy mechanism, the third portion being disposed proximate to said pivot, a close prop including a first end and a second end disposed opposite and distal from the first end, the second end including a roller cooperating with said latch lobe, and a close D-shaft pivotably coupled to the housing, said close D-shaft comprising a recess and a close latch, said close D-shaft being pivotable between a latched position corresponding to said close latch restricting movement of the first end of said close prop, and an unlatched position corresponding to said close prop being movable, wherein said third portion of said at least one rocker arm cooperates with said close D-shaft at or about said recess to hold said close latch in said unlatched position until said charging handle has been pivoted a predetermined number of strokes to charge said stored energy mechanism a predetermined amount, and wherein, after said predetermined number of strokes is achieved, said third portion of said at least one rocker arm releases said close D-shaft, thereby permitting said close latch to move to said latched position.

13. The electrical switching apparatus of claim 12 wherein, when said charging handle of said charging assembly has been pivoted said predetermined number of strokes, said cam shaft has been correspondingly pivoted a predetermined distance; and wherein said predetermined distance corresponds to said latch lobe being disposed sufficiently distal from the roller of said close prop in order that release of said charging handle and corresponding backward rotation of said cam shaft would not result in a collision between the roller and said latch lobe.

14. The electrical switching apparatus of claim 12 wherein the housing of said electrical switching apparatus includes at least one side plate; wherein said at least one side plate includes a stop; wherein said cam shaft, said at least one rocker arm, said close prop and said close D-shaft are pivotably coupled to said at least one side plate; wherein said close D-shaft further comprises a lever; and wherein, when said charging handle has been pivoted a predetermined number of strokes, said lever engages said stop.

15. The electrical switching apparatus of claim 12 wherein said third portion of said at least one rocker arm has a profile; and wherein said profile cooperates with said close D-shaft at or about said recess.

16. The electrical switching apparatus of claim 15 wherein said profile includes a first segment, a second segment, a third segment, a first transition, and a second transition; wherein said first segment is a concave; wherein said second segment and said third segment are convex; wherein said first transition is disposed between said first segment and said second segment; wherein said second transition is disposed between said second segment and said third segment; and wherein the radius of curvature of said third segment is greater than the radius of curvature of said second segment.

17. The electrical switching apparatus of claim 16 wherein, when said charging handle has not been pivoted and said stored energy mechanism has not been charged, said first transition of said profile engages said close D-shaft and holds said close latch in said unlatched position; wherein, when said charging handle has been pivoted one stroke to begin charging said stored energy mechanism, said second segment of said profile engages said close D-shaft and continues to hold said close latch in said unlatched position; wherein, when said charging handle has been pivoted four strokes, said second segment of said profile begins to release said close D-shaft; and wherein, when said charging handle has been pivoted six strokes, said second transition of said profile releases said close D-shaft, thereby releasing said close latch to move to said latched position.

18. The electrical switching apparatus of claim 12 wherein said number of cams of said cam shaft is a first cam and a second cam.

19. The electrical switching apparatus of claim 18 wherein said at least one rocker arm is a first rocker arm and a second rocker arm; wherein said first rocker arm includes a first cam roller; wherein said second rocker arm includes a second cam roller; wherein said first cam roller cooperates with said first cam; and wherein said second cam roller cooperates with said second cam.

20. The electrical switching apparatus of claim 12 wherein said charging handle comprises a charge gear and a handle fixed pawl; wherein said charge gear has a number of teeth; wherein, when said charging handle is pivoted, said handle fixed pawl cooperates with said teeth; wherein, when said charging handle is released, said cam shaft pivots backwards until said handle fixed pawl engages a corresponding one of said teeth to fix the position of said charging handle; and wherein, even if said handle fixed pawl is not engaging said corresponding one of said teeth, said third portion of said at least one rocker arm maintains said close latch in said unlatched position until said charging handle has been pivoted said predetermined number of strokes.

* * * * *